US010240490B2

(12) United States Patent
Nielsen

(10) Patent No.: US 10,240,490 B2
(45) Date of Patent: Mar. 26, 2019

(54) OIL CONTROL FOR ROCKER ARM AND HYDRAULIC LASH ADJUSTER

(71) Applicant: Eaton Corporation, Cleveland, OH (US)

(72) Inventor: Douglas J Nielsen, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/588,965

(22) Filed: May 8, 2017

(65) Prior Publication Data

US 2017/0321576 A1 Nov. 9, 2017

Related U.S. Application Data

(60) Provisional application No. 62/333,205, filed on May 7, 2016.

(51) Int. Cl.

| | |
|---|---|
| ***F01L 1/18*** | (2006.01) |
| ***F01L 1/24*** | (2006.01) |
| ***F01L 13/06*** | (2006.01) |

(52) U.S. Cl.

CPC ..... *F01L 1/2416* (2013.01); *F01L 1/18* (2013.01); *F01L 1/181* (2013.01); *F01L 1/24* (2013.01); *F01L 1/2411* (2013.01); *F01L 13/06* (2013.01); *F01L 2001/2438* (2013.01); *F01L 2001/2444* (2013.01)

(58) Field of Classification Search

CPC ..... F01L 1/18; F01L 1/24; F01L 1/181; F01L 1/2411; F01L 1/2416; F01L 2001/2438; F01L 2001/2444

USPC ..... 123/90.12, 90.13, 90.39, 90.43

See application file for complete search history.

(56) References Cited

U.S. PATENT DOCUMENTS 9,528,398 B2 * 12/2016 Jeon ..... F01L 1/2411 123/90.39

2011/0073068 A1 3/2011 Yoon

FOREIGN PATENT DOCUMENTS

| | | | |
|---|---|---|---|
| WO | 2014049388 | A1 | 4/2014 |
| WO | 2015017057 | A1 | 2/2015 |
| WO | 2016041882 | A1 | 3/2016 |

OTHER PUBLICATIONS

European Search Report for Application No. 17169932.5 dated Oct. 20, 2017; pp. 1-6.

* cited by examiner

*Primary Examiner* — Ching Chang

(74) *Attorney, Agent, or Firm* — Mei & Mark, LLP

(57) ABSTRACT

A rocker arm comprising a supply path that communicates with a first lash bore and a first spool bore. A spool is in the spool bore. A hydraulic lash device is in the first lash bore, wherein an outer body is configured to collapse during a first valve lift profile when receiving a low pressure fluid, and wherein the outer body and the inner body are configured to cooperate rigidly when receiving a high pressure fluid during a second valve lift profile. The spool is movable to a first spool position to align the spool notch with a first spool path and a second spool path, and the spool is movable to a second spool position to align the spool notch with the second spool path and an accumulator path. The supply path in to the rocker arm is the only source of fluid to the spool.

16 Claims, 6 Drawing Sheets

OIL CONTROL FOR ROCKER ARM AND HYDRAULIC LASH ADJUSTER

FIELD

This application relates to rocker arms with hydraulic circuits for enabling more than one valve lift event.

BACKGROUND

Prior hydraulic circuit designs are inefficient and require multiple pressure feeds. For example, the rocker arms of WO 2001/046578 comprise complex oil passages, including intersecting and angled passages, and numerous bores and check valves inside the rocker arm. The complexity of the device results in a high tolerance stack up and high possibility of device failure.

While an improvement over WO 2001/046578, the rocker arm assembly for engine braking disclosed in WO 2016/041882 can benefit from improvements as disclosed herein.

SUMMARY

The methods and devices disclosed herein overcome the above disadvantages and improve the art by way of improved oil control for a rocker arm.

A rocker arm for switching between a first valve lift profile and a second valve lift profile comprises a supply bore for receiving one of a high pressure fluid and a low pressure fluid. A supply path in to the rocker arm communicates with a first lash bore and a first spool bore. A spool is in the spool bore, the spool comprising a spool notch, the spool configured to reciprocate in the spool bore. At least a first spool path is in fluid communication with the spool and the first lash bore. A second lash bore is in the rocker arm. A second spool path is in fluid communication with the spool and the second lash bore. An accumulator path is in fluid communication with the spool. A hydraulic lash device is in the first lash bore, the lash device comprising an inner body and an outer body, wherein the outer body is configured to collapse during the first valve lift profile when receiving the low pressure fluid, and wherein the outer body and the inner body are configured to cooperate rigidly when receiving the high pressure fluid during the second valve lift profile. The spool is movable to a first spool position to align the spool notch with both the first spool path and the second spool path, and the spool is movable to a second spool position to align the spool notch with both the second spool path and the accumulator path. The supply path in to the rocker arm is the only source of fluid to the spool and can be the only source of fluid to the accumulator.

A method of operating a rocker arm for switching between a first valve lift profile and a second valve lift profile can comprise supplying one of a high pressure fluid and a low pressure fluid to a supply path in the rocker arm. The supplied one of the high pressure fluid and the low pressure fluid can be fluidly communicated to a first lash bore in fluid communication with the supply path, the first lash bore comprising a hydraulic lash device, then to a first spool bore. Continuing, the fluid communication is done to a needle assembly in mechanical communication with the hydraulic lash device. Then, a spool is reciprocated in the spool bore to selectively fluidly communicate the supplied one of the high pressure fluid and the low pressure fluid to an accumulator path by moving the spool from a first spool position aligning a spool notch with a first spool path to the lash bore and a second spool path to the needle assembly, and by moving the spool to a second spool position aligning the spool notch with the second spool path and the accumulator path.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1:
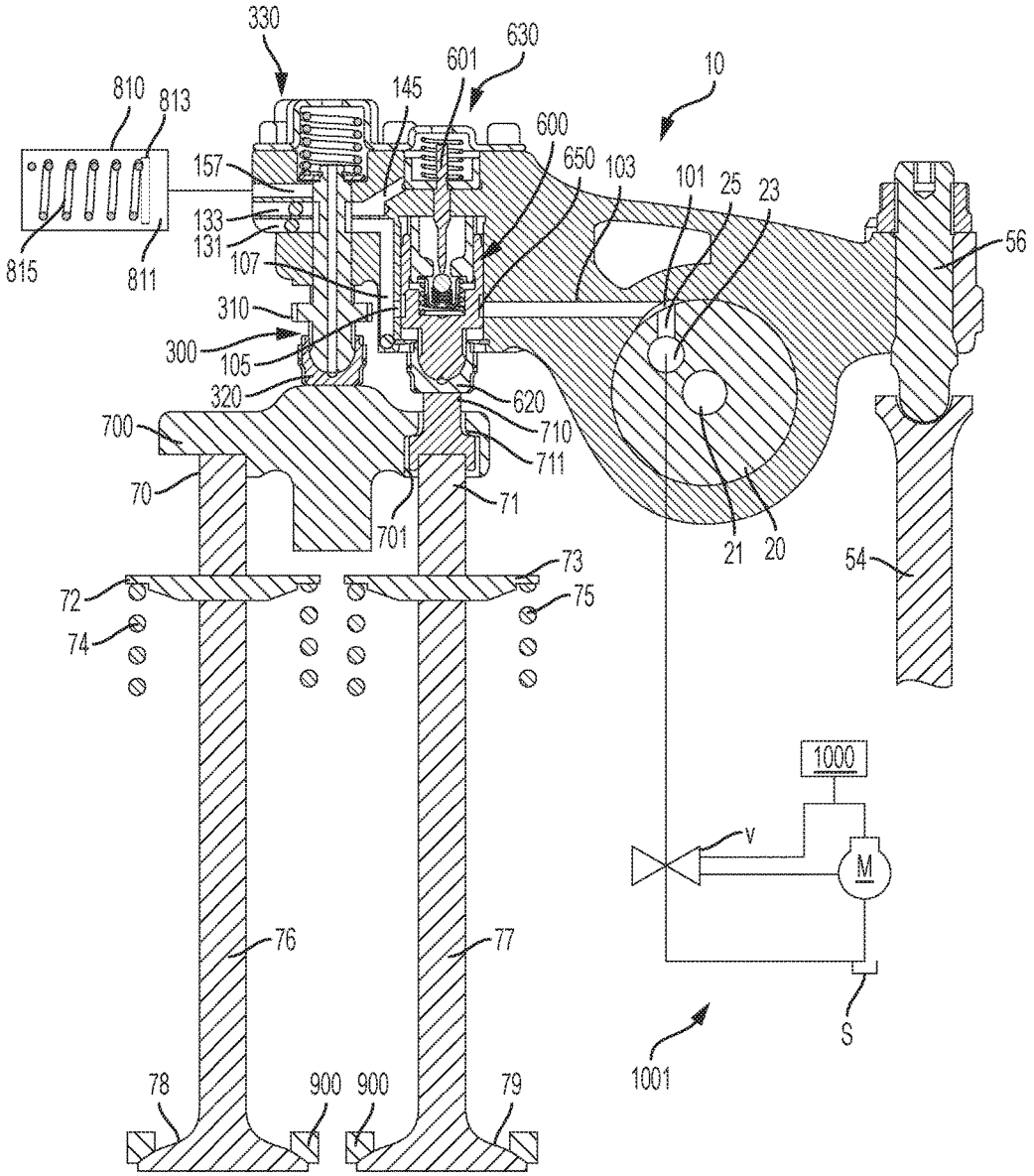
FIGS. 1-4 are views of the improved oil control circuits.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Prior oil control provided a short seal area for oil control with extremely tight tolerances. In the new design, there is no reason to do oil switching at the rocker shaft. Moving switching away from rocker shaft gives resolution to the oil pressure control, reduces tolerance stack-up, and simplifies the oil circuit.

Oil control comes down a rocker arm, pressurizes an HLA, and moves through a true spool valve. The HLA can lift during lost motion. It is possible to adjust the spool notch 306 and spool bore 135 so that pressure supplies and vents are never open at the same time, which conserves oil. The rocker arms 10, 11, 12 can be engineered to make the reset function back to a home position more definite. And, lash can occur after a lost motion event. Additionally, a supply land 101 at the supply port 25 can be scalloped to ensure constant pressurization of the oil circuit. The constant pressurization enhances reaction time.

This is accomplished as outlined in FIG. 1, where a rocker arm 10 rotates around a rocker shaft 20. The rocker shaft 20 is rotatable in supply bore 120 to align various fluid supply ports. For example, a lubrication duct 21 can go down a centerline of the rocker shaft 20 so that, in another plane of the rocker arm 10, the lubrication duct 21 can connect to lubricate an extension arm 56 in a known manner. The extension arm 56 can mechanically couple to a pushrod 54 in a known manner, as by a ball and socket joint, as illustrated, or as by an alternative such as an elephant foot (e-foot) connection. The pushrod 54 interfaces with a rotating cam for lifting and lowering the pushrod in a known manner. Mechanical or hydraulic lash adjustment mechanisms can be included in the rocker arm assemblies 10, 11, 12 or on push rod 54, based on the application.

Rocker shaft 20 comprises a switchable supply duct 23 coupled to a pressure-controlled fluid supply 1001. One example of a pressure-controller fluid supply 1001 comprises a sump S connected to a motor and pump M. A valve V directs fluid to either the switchable supply duct 23 or to the sump S. A controller 1000 can comprise a processor, memory device, and stored algorithms for executing a control strategy for the motor and pump M and valve V. For example, the control strategy can comprise supplying a nominal pressure for steady state operation. But, when an alternate lift profile, such as an engine braking lift profile, is selected, the controller 1000 can direct the motor and pump to adjust the pressure of the fluid as by increasing the fluid pressure. The valve V is controlled to direct the adjusted pressure fluid to the switchable supply duct 23 during the alternate lift profile use, and then to direct vented or released fluid back to the sump S once the alternate lift profile use is discontinued. Controller 1000 can be an integral or separate part of a main engine control unit (ECU) or other on-board processing device and can comprise allocation programming or multiple processors, as necessary to implement the multi-device control.

In an inactive state, as shown in FIG. 1, the valves 78, 79 abut their valve seats 900. An engine comprising combustion cylinders is affiliated with valve seats 900 in a known manner. Valves 78, 79 are biased to a closed position in a known manner by valve springs 74,75 biased against spring seats 72, 73 and a portion of the engine that has been removed for clarity. Valve stems 76, 77 extend towards a valve bridge 700. Stem end 70 can directly abut valve bridge 700, while stem end 71 can abut a valve coupler 710 that is seated in and slidable in stepped bridge bore 701 of valve bridge 700. Valve bridge 700 is in mechanical communication with the spool 301, while coupler 710 is in mechanical communication with the lash device 600. The valve coupler 710 can comprise a neck for receiving stem end 71, and a neck-down portion for interfacing with an e-foot 620 on lash device 600. A shoulder 711 on the valve coupler 710 can seat against a step in the stepped bridge bore 701.

During nominal steady state operation, valve 79 moves with valve 78 when the valve bridge 700 is acted on by pressure from rocker arm by way of spool assembly 300. This is because the lash device 600 is a hydraulic lash device, it is supplied with a low pressure fluid P1 that allows the lash device 600 to collapse.

The lash device can comprise an inner body 606 comprising a low pressure chamber 661, an inner lash path 653, and a check seat in the form of a shoulder 6060 surrounding the inner lash path. An outer body 605 can comprise a pressure chamber 663, and a movable check device such as ball 604 for selectively seating against the check seat (shoulder 6060) or for selectively opening the inner lash path 653. Check device can be other than a ball 604, such as a disc or other sealing mechanism.

Figure 2:
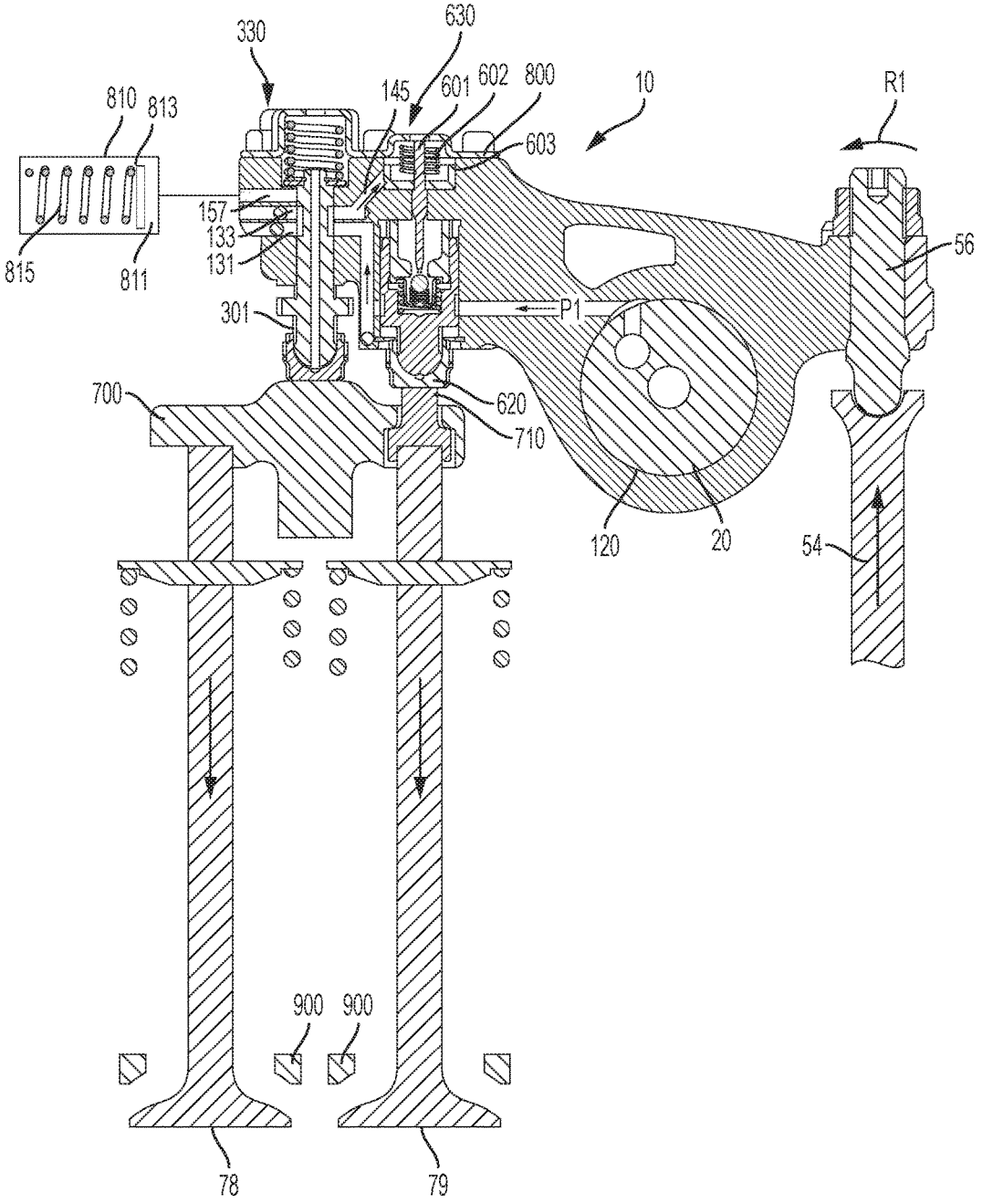

During nominal steady state operation, comprising the low pressure fluid P1, the needle assembly, comprising needle 601, needle spring 602, and needle cup 603, does not move. The low pressure fluid P1 cannot raise the needle cup 603, so needle 601 pushes ball away from shoulder 6060 and fluid cannot be trapped in high pressure chamber 663. Fluid can circulate to low pressure chamber 661 via a notch or hole in inner body 606, and thereafter, the fluid circulates to high pressure chamber 663. Leakdown pathways can also be included, as known in the art. In FIG. 2, fluid can move across a lash notch 650 in outer body 605 to traverse first lash bore 160. The lash notch 650 can supply either the high pressure fluid P2 or the low pressure fluid P1 across the first lash bore 161 to the first spool path 131. The fluid can leak in to the lash device 600 via leakdown pathways or fluid ports. Outer body 605 reciprocates in first lash bore 160 to compress as the rocker arm 10 rotates in an actuation stroke and to expand as the body spring 607 expands when the rocker arm returns to its home position after the actuation stroke. As the rocker arm 10 rotates a rotation amount R1 by action from the push rod 54, as shown in FIG. 2, the spool 301 acts on valve bridge 700 by way of e-foot 320. Shoulder 711 is pressed by the step in the stepped bore 701 so then stem ends 70, 71 move to push valves 78, 79 down.

Figure 3:
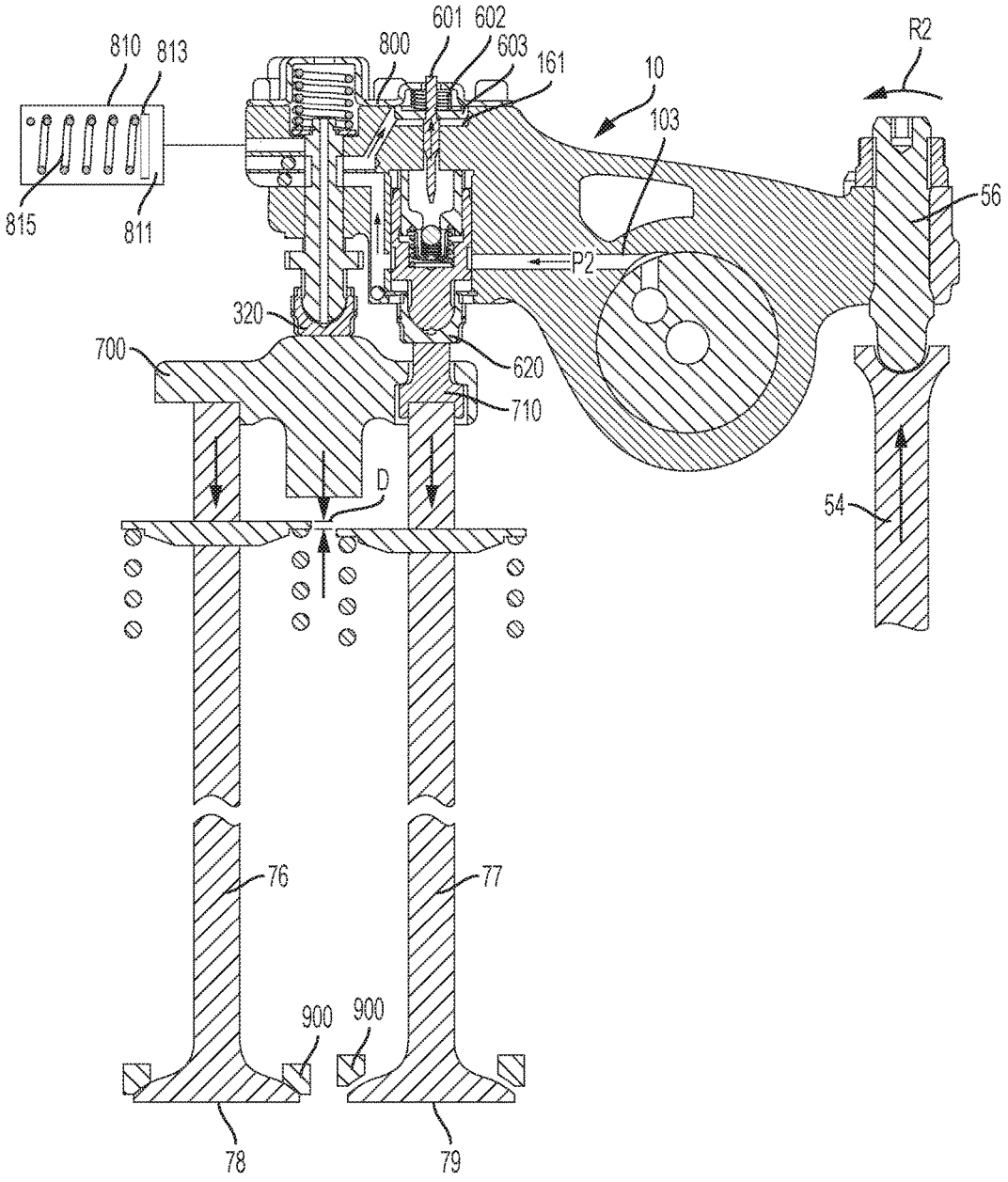
Figure 4:
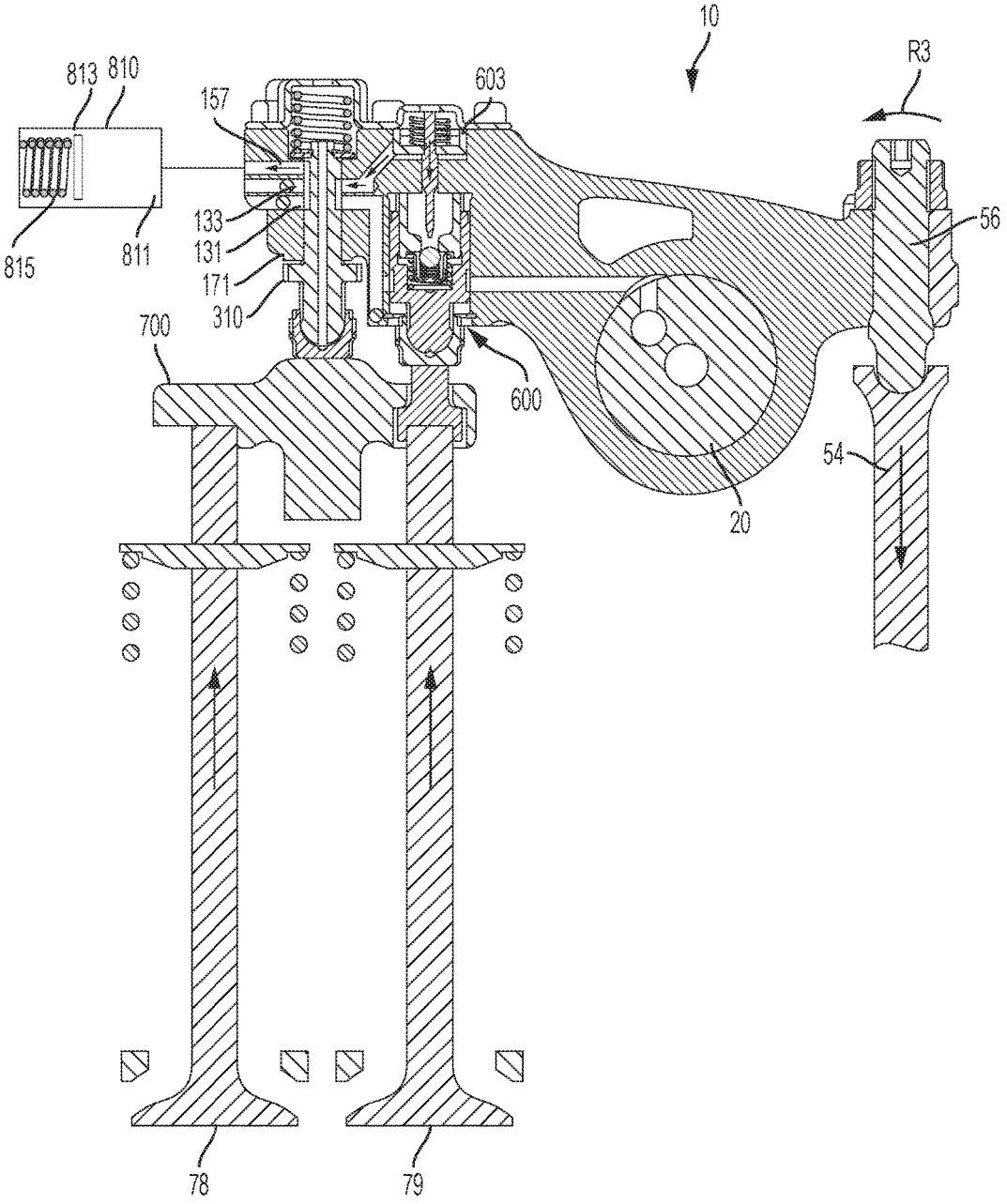

But, in other operating conditions, such as the alternate lift profile, the lash device 600 is configured to push on valve coupler 710 and move valve 79 before the valve bridge 700 pushes on stem end 70. This is shown in FIG. 3, where the valve 79 moves a distance D illustrated between two thick arrows. A high pressure fluid P2 is supplied from pressure-controlled fluid supply 1001 to lash device 600. The high pressure fluid P2 enters high pressure chamber 663, intermediate path 107, spool notch 306, needle path 145, and second lash bore 161. High pressure fluid P2 is adequate to lift needle cup 603, and therefore needle 601. This removes needle 601 from the check device (ball 604). A press-fit or snap ring or other coupling can hold the needle 601 to the needle cup 603. Ball spring 608 pushes ball 604 upwards against shoulder 6060, and the high pressure fluid P2 is trapped in high pressure chamber 663. The outer body 605 cannot collapse in first lash bore 160.

When the rocker arm 10 has rotated a rotation amount R2 by action from the push rod 54, the rotation amount R2 is sufficient to move valve 79 the distance D2 for the alternative lift profile. So, valve 79 opens before spool 301 has travelled enough to abut spool collar 310 against rocker arm outer surface 171, so spool has not yet moved valve bridge 700. Rotation amount R2 is also insufficient to move the spool 301 enough to couple the high pressure fluid P2 to accumulator path 157. The high pressure fluid P2 is trapped to keep lash device 600 firm. An alternate valve lift profile, such as engine braking or early valve opening, can be accomplished via the small lift of valve 79 and via the cam configuration pressing on push rod 54. Additional or alternative actuation mechanisms, such as latches or hydraulic capsules, can be included to further adjust the rotation amounts R1, R2, R3, R4.

When the rocker arm 10 rotates a rotation amount R3 in the high pressure fluid scenario or the low pressure fluid scenario, the spool 301 lifts to abut spool collar 310 against rocker outer surface 171, which couples spool notch 306 to second spool path 133, needle path 145, and accumulator path 157. That is, the spool 301 is movable to align the spool notch 305 with the first spool path 131 and the second spool path 133 in a first spool position, and the spool 301 is movable to align the spool notch 306 with the second spool path 133 and the accumulator path 157 in a second spool position. In the drawings, the needle path 145 is illustrated as a separately drilled, angled port in the rocker arm, however, the needle path 145 can alternatively be an extension of the second spool path 133 as by adjusting the height or location of the lash device 600.

With the spool 301 in the second spool position, fluid from under needle cup 603 can release to accumulator 810 or like device, or even to a sump. When the fluid releases, the needle cup 603 can drop and return needle 601 to push ball 604 away from shoulder 6060 to permit lash device 600 to collapse in to a low pressure state. Accumulated high pressure fluid P2 can compress seal 813 against spring 815 to fill chamber 811. When the rocker arm rotation direction reverses to return to the home position, the spring 815 can push the seal 813 and push the accumulated fluid out back towards sump S. This can be done with concurrent control of valve V by controller 1000. In the alternative, a vent line can be included in the rocker shaft 20 for alleviating fluid pressure from the rocker arm.

Figure 5:
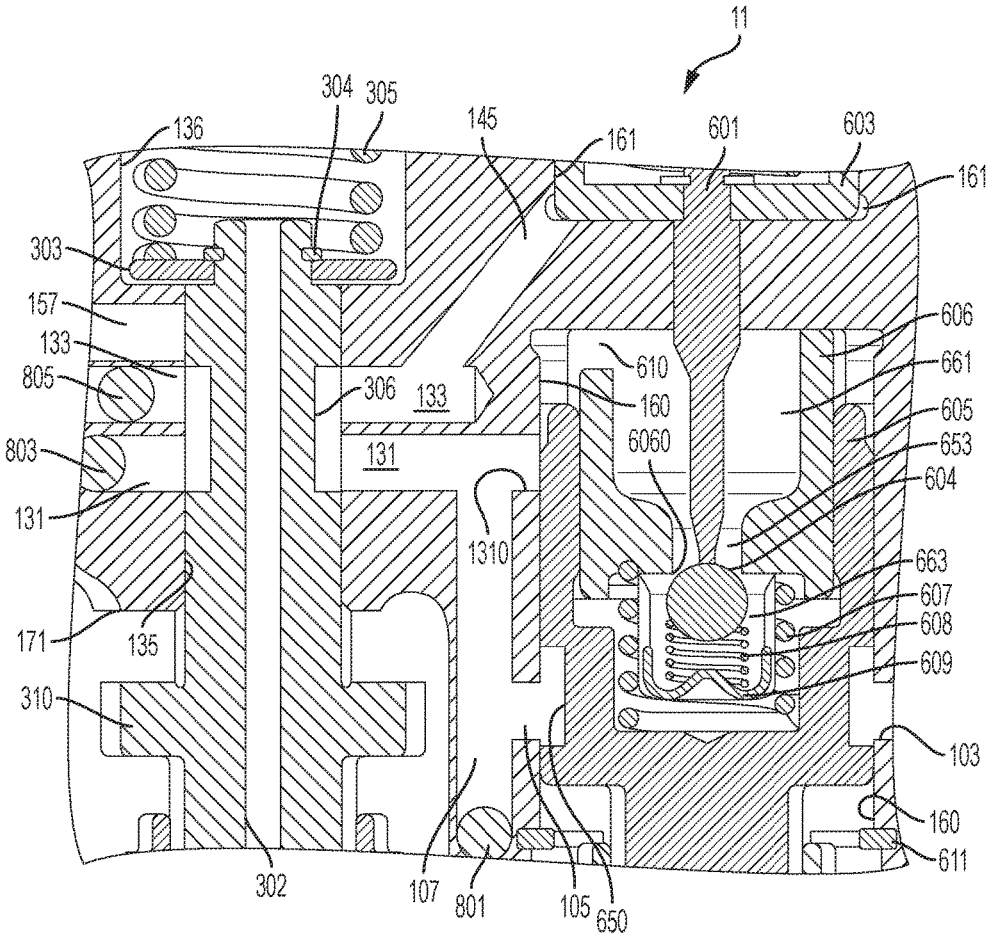
FIGS. 5 & 6 are section views of alternative oil control circuits.

FIG. 5 shows an alternative embodiment of a rocker arm 11 usable with the above techniques. An extension 1310 is included to first spool path 131 so that first spool path 131 fluidly communicates with first lash bore 160 at an upper end of the first lash bore 160. This additional fluid path increases circulation to the lash device 600. A notch 610 can also be included for increased internal circulation, or holes or leak-down pathways can be used.

FIG. 5 also includes details for plugs 801, 803, 805 in drilled ports for intermediate path 107, first spool path 131 and second spool path 133. A snap ring 611 for holding outer body 605 in first lash bore 160 can also be seen. Exemplary details of a spool biasing mechanism 330 are shown in FIG. 5, where a spool spring 305 is biased to push against a spool disc 303, which is secured to spool 301 by a snap ring 304 or other fixment, such as a press-fit.

Figure 6:
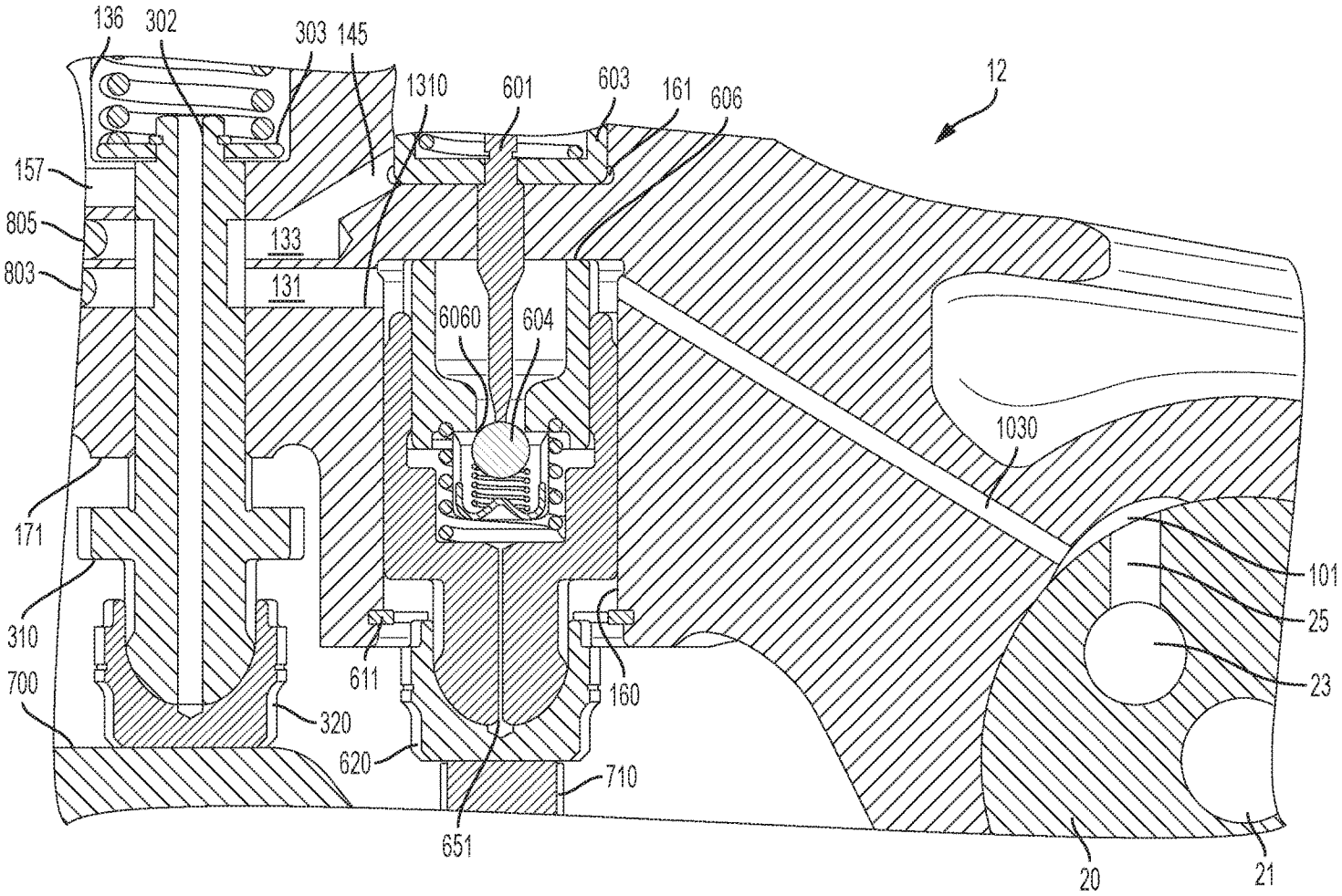

In the prior figures, the first lash bore 161 comprises a top end near the second lash bore 161, and a bottom end opposite the top end. The supply path 103 communicates with the bottom end of the lash bore 160. FIG. 6 shows an alternative embodiment for rocker arm 12, usable with many of the above techniques. In FIG. 6, the lash bore 160 comprises a top end near the second lash bore 161 and a bottom end opposite the top end and near a mechanical coupling point to a valve. That is, the bottom end is near the e-foot 620 and the coupler 710 in the valve bridge 700. The supply path 1030 communicates with the top end of the lash bore. Instead of a horizontal drilling in the rocker arm 10, 11, rocker arm 12 comprises an alternative supply path 1030 that is angled to go directly to the top of the first lash bore 160. This eliminates the need for intermediate path 107 and lash notch 650 in outer body 605. While the outer body is extended, low or high pressure fluid can communicate across the first lash bore 160 to first spool path 131. The first spool path 131 can comprise the extension 1310 to the first lash bore 160.

The spool biasing mechanism 330 and the needle assembly 630 (comprising needle 601, needle spring 602, and needle cup 603) are secured to rocker arms 10-12 by a cover 800. The cover 800 also serves to bias spool spring 305 and needle spring 602 to return, respectively, spool 301 and needle 601 to their home positions.

Respective lubrication ports 302, 651 can be included in the spool 301 and outer body 605 to lubricate the respective couplings e-feet 320, 620. Spool lubrication port 302 can be fed as by a cross drilling in the spool.

By using the lash device 600 as a fluid pass-through device, the rocker arms 10, 11, 12 minimize drilling, which ensures better tolerances. By using a switchable oil supply on the single switchable supply duct 23, there is also less complexity on the rocker shaft, fewer lands in the rocker arm, and therefor fewer opportunities for leak paths. The design is also compatible with other goals, such as lubrication of the e-foot couplings, use of hydraulic or mechanical lash adjusters, and lubrication of the pushrod-to-rocker arm interface.

The improved oil flow circuits described above result in simplified rocker arm internals. Instead of multiple oil flow paths to the valve actuation assembly, the rocker arm consists essentially of a single oil supply path to the spool valve or to the accumulator. The rocker arm can consist essentially of: a supply path in to the rocker arm communicating with a first lash bore and a first spool bore. A spool is in the spool bore, the spool comprising a spool notch, the spool configured to reciprocate in the spool bore. At least a first spool path is in fluid communication with the spool and the first lash bore. A second lash bore is in the rocker arm. A second spool path is in fluid communication with the spool and the second lash bore. An accumulator path is in fluid communication with the spool. A hydraulic lash device is in the first lash bore, the lash device comprising an inner body and an outer body, wherein the outer body is configured to collapse during the first valve lift profile when receiving the low pressure fluid, and wherein the outer body and the inner body are configured to cooperate rigidly when receiving the high pressure fluid during the second valve lift profile. The spool is movable to a first spool position to align the spool notch with both the first spool path and the second spool path, and the spool is movable to a second spool position to align the spool notch with both the second spool path and the accumulator path.

Other implementations will be apparent to those skilled in the art from consideration of the specification and practice of the examples disclosed herein.

What is claimed is:

1. A rocker arm for switching between a first valve lift profile and a second valve lift profile, comprising:

a supply bore for receiving one of a high pressure fluid and a low pressure fluid;

a supply path in to the rocker arm from the supply bore;

a first lash bore in fluid communication with the supply path;

a first spool bore;

a spool in the first spool bore, the spool comprising a spool notch, the spool configured to reciprocate in the first spool bore;

at least a first spool path in fluid communication with the spool and the first lash bore;

a second lash bore;

a second spool path in fluid communication with the spool and the second lash bore;

an accumulator path in fluid communication with the spool; and a hydraulic lash device in the first lash bore, the hydraulic lash device comprising an inner body and an outer body, wherein the outer body is configured to collapse during the first valve lift profile when receiving the low pressure fluid, and wherein the outer body and the inner body are configured to cooperate rigidly when receiving the high pressure fluid during the second valve lift profile, wherein, the spool is movable to a first spool position to align the spool notch with the first spool path and the second spool path, and the spool is movable to a second spool position to align the spool notch with the second spool path and the accumulator path, and wherein the supply path in to the rocker arm is the only source of fluid to the spool.

2. The rocker arm of claim 1, further comprising a rocker shaft in the supply bore, the rocker shaft comprising a lubrication duct and a switchable supply duct, the switchable supply duct comprising a supply port in communication with the supply path.

3. The rocker arm of claim 1, where the first spool path comprises an extension for fluidly communicating with a top end of the first lash bore.

4. The rocker arm of claim 3, further comprising a lash path in fluid communication with the first lash bore, and an intermediate path between the lash path and the first spool path.

5. The rocker arm of claim 3, wherein the first lash bore comprises a top end near the second lash bore and a bottom end opposite the top end and near a mechanical coupling point to a valve, and wherein the supply path communicates with the top end of the first lash bore.

6. The rocker arm of claim 1, further comprising a lash path in fluid communication with the first lash bore, and an intermediate path between the lash path and the first spool path.

7. The rocker arm of claim 6, wherein the hydraulic lash device outer body comprises a lash notch for supplying the one of the high pressure fluid or the low pressure fluid across the first lash bore to the first spool path.

8. The rocker arm of claim 1, wherein the first lash bore comprises a top end near the second lash bore and a bottom end opposite the top end, and wherein the supply path communicates with the bottom end of the first lash bore.

9. The rocker arm of claim 8, further comprising a needle assembly in the second lash bore, the needle assembly comprising a needle cup biased by a needle spring, and a needle affixed to the needle cup, wherein needle contacts the check device when the supply bore receives a low pressure fluid, and wherein the needle cup lifts the needle away from the check device when the supply bore receives a high pressure fluid.

10. The rocker arm of claim 1, wherein the first lash bore comprises a top end near the second lash bore and a bottom end opposite the top end and near a mechanical coupling point to a valve, and wherein the supply path communicates with the top end of the first lash bore.

11. The rocker arm of claim 1, wherein:

the inner body further comprises a low pressure chamber, an inner lash path, and a check seat surrounding the inner lash path;

the outer body further comprises a pressure chamber and a movable check device for selectively seating against the check seat or for selectively opening the inner lash path.

12. The rocker arm of claim 1, further comprising: a valve bridge in mechanical communication with the spool; a coupler in mechanical communication with the hydraulic lash device, wherein the coupler seats in the valve bridge.

13. The rocker arm of claim 1, wherein the second spool path comprises a needle path angled with respect to the spool.

14. The rocker arm of claim 1, further comprising an accumulator in fluid communication with the accumulator path, wherein the supply path in to the rocker arm is the only source of fluid to the accumulator.

15. A method of operating a rocker arm for switching between a first valve lift profile and a second valve lift profile, comprising:

supplying one of a high pressure fluid and a low pressure fluid to a supply path in the rocker arm;

fluidly communicating the supplied one of the high pressure fluid and the low pressure fluid to a first lash bore in fluid communication with the supply path, the first lash bore comprising a hydraulic lash device;

fluidly communicating the supplied one of the high pressure fluid and the low pressure fluid to a first spool bore from the supply path;

fluidly communicating the supplied one of the high pressure fluid and the low pressure fluid from the first spool bore to a needle assembly in mechanical communication with the hydraulic lash device; and reciprocating a spool in the first spool bore, the spool comprising a spool notch, to selectively fluidly communicate the supplied one of the high pressure fluid and the low pressure fluid to an accumulator path by moving the spool from a first spool position aligning the spool notch with a first spool path to the first lash bore and a second spool path to the needle assembly, and by moving the spool to a second spool position aligning the spool notch with the second spool path and the accumulator path.

16. A rocker arm for switching between a first valve lift profile and a second valve lift profile, consisting essentially of:

a supply bore for receiving one of a high pressure fluid and a low pressure fluid;

a supply path in to the rocker arm from the supply bore;

a first lash bore in fluid communication with the supply path;

a first spool bore;

a spool in the first spool bore, the spool comprising a spool notch, the spool configured to reciprocate in the first spool bore;

at least a first spool path in fluid communication with the spool and the first lash bore;

a second lash bore;

a second spool path in fluid communication with the spool and the second lash bore;

an accumulator path in fluid communication with the spool;

a hydraulic lash device in the first lash bore, the hydraulic lash device comprising an inner body and an outer body, wherein the outer body is configured to collapse during the first valve lift profile when receiving the low pressure fluid, and wherein the outer body and the inner body are configured to cooperate rigidly when receiving the high pressure fluid during the second valve lift profile, wherein, the spool is movable to a first spool position to align the spool notch with the first spool path and the second spool path, and the spool is movable to a second spool position to align the spool notch with the second spool path and the accumulator path.

* * * * *